US005589819A

United States Patent [19]

Takeda

[11] Patent Number: 5,589,819

[45] Date of Patent: Dec. 31, 1996

[54] SELF-SOUNDING TAG ALARM

[75] Inventor: Harumi Takeda, Osakasayama, Japan

[73] Assignee: Takeda Technological Research Co., Ltd., Osaka, Japan

[21] Appl. No.: 292,750

[22] Filed: Aug. 18, 1994

[30] Foreign Application Priority Data

Aug. 23, 1993 [JP] Japan ..... 5-230935

[51] Int. Cl.[6] ..... G08B 13/14

[52] U.S. Cl. ..... 340/571; 340/572

[58] Field of Search ..... 340/571, 572

[56] References Cited

U.S. PATENT DOCUMENTS

| | | | |
|---|---|---|---|
| 4,573,042 | 2/1986 | Boyd et al. | 340/571 X |
| 4,812,811 | 3/1989 | Asbrink et al. | 340/571 |
| 4,851,815 | 7/1989 | Enkelmann | 340/571 |
| 4,992,776 | 2/1991 | Crossfield | 340/572 X |
| 5,245,317 | 9/1993 | Chidley et al. | 340/571 |

FOREIGN PATENT DOCUMENTS

| | | | |
|---|---|---|---|
| 233163A1 | 8/1987 | European Pat. Off. . | |
| 341828A1 | 11/1989 | European Pat. Off. . | |
| 274561 | 10/1993 | Japan | 340/571 |

*Primary Examiner*—Thomas Mullen

*Attorney, Agent, or Firm*—Nikaido, Marmelstein, Murray & Oram LLP

[57] ABSTRACT

A self-sounding tag alarm apparatus having a tag type main body attached to a commodity and automatically operable to sound an alarm when an attempt is made to steal the commodity. The apparatus includes a coupling such as a wire, pin or the like for detachably attaching the main apparatus body to the commodity, an alarm generator mounted in the main apparatus body, a detector for detecting a signal of a particular frequency produced externally of the main apparatus body and removal of the coupling, a reset signal intake device for taking into the main apparatus body a reset signal applied externally of the main apparatus body, and an alarm control device for rendering the alarm generator operative based on a detection signal received from the detector, and rendering the alarm generator inoperative based on the reset signal received from the reset signal intake device.

6 Claims, 7 Drawing Sheets

SELF-SOUNDING TAG ALARM

BACKGROUND OF THE INVENTION

1. Field of the Invention

The present invention relates to an alarm apparatus for use in a shoplift preventive system or the like. More particularly, the invention relates to a self-sounding tag alarm apparatus having a tag type body attached to a commodity and automatically operable to sound an alarm when an attempt is made to steal the commodity.

2. Description of the Related Art

Conventionally, this type of self-sounding tag alarm apparatus is used in a shoplift preventive system employing a detector having a gate (antenna) of the electromagnetic induction coupling type or the like.

In the shoplift preventive system, the self-sounding tag alarm apparatus is attached to a commodity, e.g. an article of clothing, by means of a wire, pin, adhesive tape or the like, and placed in a salesroom. When a shoplifter, in an attempt to take the commodity without paying, passes through a gate adjacent a cashier's counter, the self-sounding tag alarm apparatus attached to the commodity receives an electromagnetic wave of a particular frequency from the gate. Then, the alarm apparatus resonates with the electromagnetic wave, and sounds an alarm. If a shoplifter removes the self-sounding tag alarm apparatus from the commodity before walking off with the commodity, the alarm apparatus detects detachment of the wire or the like and gives an alarm.

In a proper shopping action, a cashier removes the self-sounding tag alarm apparatus from the commodity after canceling the detecting mechanism of the alarm apparatus. Thus, no alarm is given in this case. This canceling operation is carried out mechanically with an alarm cancel key or a special jig.

The conventional alarm apparatus constructed as described above has the following disadvantage.

In the conventional apparatus, the mechanically operable alarm cancel key is inserted into a keyhole, or the special jig is fitted, to cancel the alarm by mechanically stopping the internal detecting mechanism. This alarm canceling operation is very troublesome, and tends to retard an accounting process.

SUMMARY OF THE INVENTION

The present invention has been made having regard to the state of the art noted above, and its object is to provide a self-sounding tag alarm apparatus which facilitates an alarm canceling operation to present no obstruction to an accounting process.

The above object is fulfilled, according to the present invention, by a self-sounding tag alarm apparatus for use on a commodity to prevent shoplifting, the apparatus comprising:

coupling means for detachably attaching a main apparatus body to the commodity;

alarm generating means mounted in the main apparatus body for generating an alarm;

detecting means for detecting a signal of a particular frequency produced externally of the main apparatus body and/or removal of the coupling means;

reset signal intake means for taking into the main apparatus body a reset signal applied externally of the main apparatus body; and alarm control means for rendering the alarm generating means operative based on a detection signal received from the detecting means, and rendering the alarm generating means inoperative based on the reset signal received from the reset signal intake means.

According to the present invention, when a shoplifter attempts to walk off with a commodity with the main apparatus body attached thereto, the detecting means in the main apparatus body detects the signal of a particular frequency emitted, for example, from adjacent a cashier's counter, whereby the alarm generating means operates to give an alarm. When an attempt is made to walk off with the commodity after removing the main apparatus body therefrom, detachment of the coupling means from the main apparatus body is detected by the detecting means to operate the alarm generating means. On the other hand, when the commodity is brought with the main apparatus body attached thereto to a cashier's counter to purchase it properly, the reset signal intake means takes in the reset signal emitted from a device installed in a cashier's area or the like. Based on this reset signal, the alarm control means renders the alarm generating means inoperative. Subsequently, the main apparatus body is removed from the commodity, and the latter is handed over to the purchaser.

Thus, according to the present invention, the alarm may be canceled automatically by the predetermined reset signal without a troublesome mechanical operation. This alarm canceling operation is easy and does not obstruct an accounting process.

Preferably, the coupling means comprises a wire, pin, clip or adhesive tape for connecting the main apparatus body to the commodity. Then, the detecting means, preferably, is operable to generate electrical binary conditions in response to connection and disconnection of the wire or the like to/from the main apparatus body. The electrical binary conditions are identified to operate the alarm generating means, for effectively preventing the commodity from being improperly taken out with the coupling means detached.

Preferably, the detecting means includes a resonator circuit for detecting an electromagnetic wave which is the signal of a particular frequency produced externally of the main apparatus body. Based on a detection signal from the resonator circuit, the alarm generating means is operated to effectively prevent the commodity from being taken out with the main apparatus body attached thereto.

The reset signal intake means is not limited to any specific construction as long as the reset signal is taken into the main apparatus body from outside to render the alarm generating means inoperative. The following constructions may be employed to advantage.

For example, the reset signal intake means includes a resonator circuit for detecting an electromagnetic wave of a predetermined frequency (reset signal) different from the signal of a particular frequency produced externally of the main apparatus body, and a comparator enabled when an output of the resonator circuit exceeds a predetermined level.

Instead of the above, the reset signal intake means may include an external terminal for taking in a signal of a predetermined voltage (reset signal) applied externally of the main apparatus body, and a comparator enabled when the signal taken in by the external terminal exceeds a predetermined level.

In another example, the reset signal intake means includes an external terminal for taking in a predetermined pulse signal (reset signal) applied externally of the main apparatus body, a pulse detecting circuit for outputting a predetermined voltage upon detection of the pulse signal taken in by the external terminal, and a comparator enabled when the voltage outputted from the pulse detecting circuit exceeds a predetermined level.

Further, the reset signal intake means may comprise a pair of open external terminals arranged on the main apparatus body, the open external terminals being short-circuited externally of the main apparatus body to apply a short-circuited state as a reset signal to the alarm control means.

In a still further example, the reset signal intake means includes a magnetic sensor enabled upon detection of magnetism (reset signal) produced externally of the main apparatus body.

With any one example of the reset signal intake means set out above, the alarm generating means may be rendered inoperative with ease.

BRIEF DESCRIPTION OF THE DRAWINGS

For the purpose of illustrating the invention, there are shown in the drawings several forms which are presently preferred, it being understood, however, that the invention is not limited to the precise arrangements and instrumentalities shown.

DETAILED DESCRIPTION OF THE PREFERRED EMBODIMENTS

Preferred embodiments of the present invention will be described in detail hereinafter with reference to the drawings.

First, various modes of attaching a self-sounding tag alarm apparatus to a commodity will be described.

(1) Wire Mode: The self-sounding tag alarm apparatus is attached to a commodity by means of a wire passed through the commodity. Alarm action takes place when the wire is cut or detached.

(2) Pin Mode: The self-sounding tag alarm apparatus is attached to a commodity by means of a pin pierced through the commodity and having a tip end thereof inserted into the alarm apparatus. Alarm action takes place when the pin is pulled out.

(3) Clip Mode: The self-sounding tag alarm apparatus is attached to a commodity by means of a clip having an appropriate clasping force. Alarm action takes place when detachment of the clip is detected by a clasping force detecting circuit in the alarm apparatus.

(4) Adhesive Mode: The self-sounding tag alarm apparatus is attached to a commodity through adhesive tape or the like. Alarm action takes place when a limit switch or the like detects separation of the alarm apparatus from the commodity.

The above four modes constitute main attaching modes. The present invention is applicable to the self-sounding tag alarm apparatus attached in any one of the above modes. In the following embodiments, the self-sounding tag alarm apparatus is attached in (1) Wire Mode, by way of example.

<First Embodiment>

Figure 1:
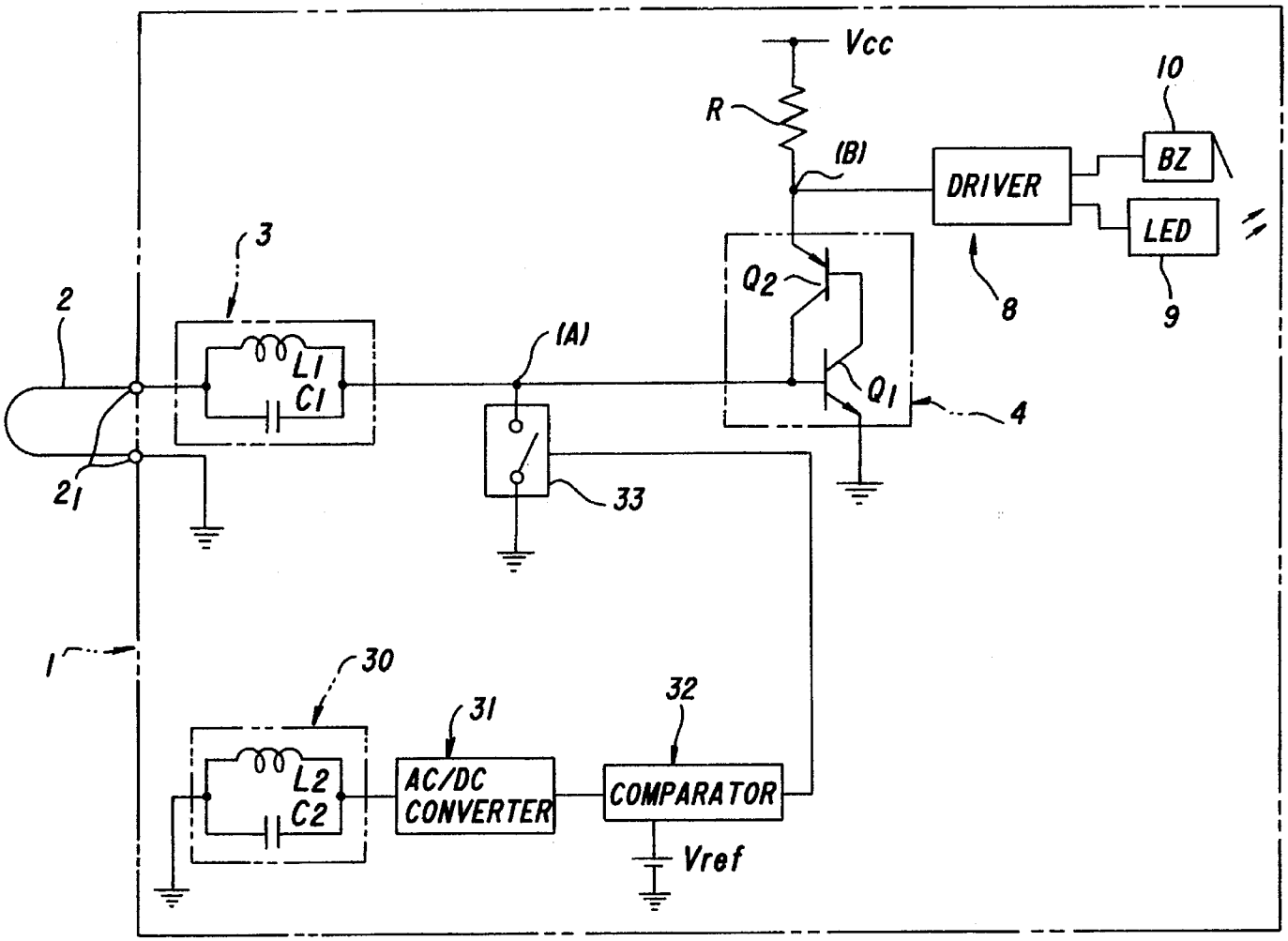
FIG. 1 is a circuit block diagram of a self-sounding tag alarm apparatus in a first embodiment of the present invention.

FIG. 1 is a circuit block diagram showing the self-sounding tag alarm apparatus attached in the wire mode according to the present invention.

Numeral 1 in FIG. 1 denotes a main body of the self-sounding tag alarm apparatus, with an external conductive wire 2 connected thereto through wire terminals 21 for use in connecting the alarm apparatus to a commodity. One of the wire terminals 21 is grounded, while the other is connected to an f1 resonator circuit 3 including a coil of inductance L1 and a capacitor of capacitance C1 for resonating with an electromagnetic wave of frequency f1. The f1 resonator circuit 3 is connected to the base terminal of a transistor Q1 in a lock hold circuit 4 including transistors Q1 and Q2. The lock hold circuit 4 has the emitter terminal of transistor Q2 connected through a resistor R to a power source Vcc in the main body 1 of the self-sounding tag alarm apparatus. Further, a driver 8 is connected to the emitter terminal of transistor Q2 of the lock hold circuit 4 for driving a light emitting diode 9 and a buzzer 10 to give an alarm.

Between the base terminal of transistor Q1 in the lock hold circuit 4 and the ground is connected a control switch 33 having a low ON-state resistance. An output terminal of a comparator 32 is connected to a control terminal of the control switch 33. A reference voltage Vref is set to the comparator 32. An output terminal of an AC/DC converter 31 for converting alternating current to direct current is connected to an input terminal of the comparator 32. To an input terminal of the AC/DC converter 31 is connected an f2 resonator circuit 30 including a coil of inductance L2 and a capacitor of capacitance C2 for resonating with an electromagnetic wave of frequency f2.

Operations of the main body 1 of this self-sounding tag alarm apparatus will be described next.

(1) Normal State:

An operation of the main body 1 of this self-sounding tag alarm apparatus remaining attached to a commodity such as an article of clothing will be described.

The f1 resonator circuit 3 does not resonate in this state, and therefore a voltage at point (A) is substantially the same as ground potential. Thus, the transistor Q1 of the lock hold circuit 4 is in "OFF state", and the transistor Q2 is also in "OFF state". A potential at point (B) is substantially the same as the voltage of power source Vcc. The driver 8 connected to point (B) causes the light emitting diode 9 emit light and the buzzer 10 to give a sound when an input voltage to the driver 8 is "low". The light emitting diode 9 and buzzer 10 are not driven when the input voltage to the driver 8 is "high". In the normal state, the input voltage to the driver 8 is "high", and hence the main body 1 of the self-sounding tag alarm apparatus does not give an alarm.

(2) Passage through a Gate:

An operation of the main body 1 of this self-sounding tag alarm apparatus remaining attached to a commodity such as an article of clothing and passed through a gate radiating an electromagnetic wave of frequency f1 will be described next.

The f1 resonator circuit 3 first resonates with the electromagnetic wave of frequency f1 from the gate, and generates a voltage substantially proportional to inductance L1. Inductance L1 of this coil has a value to provide a voltage higher than base-emitter voltage VBE1 of transistor Q1 in the lock hold circuit 4. Thus, the voltage generated by the f1 resonator circuit 3 places the transistor Q1 of the lock hold circuit 4 in "ON state", whereby the transistor Q2 also becomes "ON state". In this state, the potential at point (B) is "low", which operates the driver 8 to drive the light emitting diode 9 and buzzer 10 to give an alarm.

Once the f1 resonator circuit 3 resonates, the transistor Q1 of the lock hold circuit 4 is maintained in "ON state" even after termination of the resonance. The transistor Q1 is maintained in "ON state" by a base current thereof continuing to be supplied through the collector terminal of transistor Q2 which is also in "ON state".

(3) Wire Breaking:

The self-sounding tag alarm apparatus 1 is attached to a commodity such as an article of clothing by means of the attaching wire 2. An operation of the apparatus upon breaking or detachment of the attaching wire 2 will be described.

One of the terminals of the f1 resonator circuit 3 first becomes afloat from ground potential, to place the transistors Q1 and Q2 of the lock hold circuit 4 in "ON state". The potential at point (B) is maintained "low" to give an alarm.

Even if the broken or detached attaching wire 2 is restored, the transistor Q2 of the lock hold circuit 4 continues to supply current to the base of transistor Q1. Thus, the alarm can be canceled only by (4) Reset Operation described below.

(4) Reset Operation:

A reset operation will be described next, which is for canceling the alarm given by the main body 1 of the self-sounding tag alarm apparatus as a result of (2) Passage through a Gate or (3) Wire Breaking described above.

The reset operation is effected by emitting the electromagnetic wave of frequency f2 to the main body 1 of the self-sounding tag alarm apparatus. An outline of a reset device for emitting this electromagnetic wave will be described with reference to FIG. 2A.

Figure 2A:
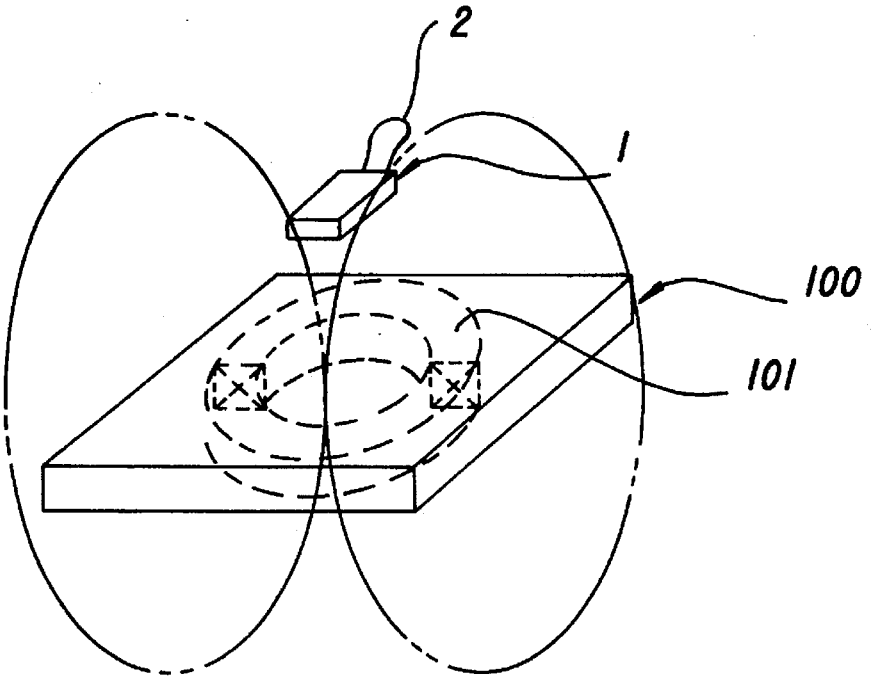
FIGS. 2A and 2B are views each showing an outline of a reset device.

Numeral 100 in FIG. 2A denotes a main body of the reset device. The main body 100 contains an f2 oscillator 101 formed of a coil or the like for emitting the electromagnetic wave of frequency f2, a source circuit not shown, and a switch or the like, not shown, for starting operation. Further, the main body 100 of the reset device includes a monitor lamp or the like disposed on a peripheral surface thereof for enabling confirmation of its operation.

The main body 100 of the reset device emits the electromagnetic wave of frequency f2 with an appropriate field strength when a source switch, not shown, is placed in "ON state".

The main body 100 of the reset device may have a ferromagnetic material such as steel provided on a lower surface thereof to increase density of the electromagnetic wave emitted.

The alarm is stopped by the following circuit action when the main body 1 of the self-sounding tag alarm apparatus giving the alarm is moved into an electromagnetic field of the electromagnetic wave emitted from the main body 100 of the reset device.

The f2 resonator circuit 30 in the main body 1 of the self-sounding tag alarm apparatus resonates with the electromagnetic wave of frequency f2 emitted from the main body 100 of the reset device. As a result, an alternating voltage is induced between the f2 resonator circuit 30 and the ground. The inductance L2 of f2 resonator circuit 30 is set such that the alternating voltage induced has a peak voltage higher than the reference voltage Vref of comparator 32. The AC/DC converter 31 converts this alternating voltage into a direct current through full-wave rectification and smoothing. The comparator 32 compares the converted voltage with the reference voltage Vref. The output terminal of the comparator 32 becomes "ON state" to place the control switch 33 in "ON state" when the converted voltage is higher than the reference voltage Vref, and becomes "OFF state" to place the control switch 33 in "OFF state" when the converted voltage is lower than the reference voltage Vref. In (1) Normal State described above, the control switch 33 is in "OFF state". In a reset state, the control switch 33 is in "ON state" whereby the potential at point (A) substantially corresponds to the ground. The collector terminal of transistor Q2 in the lock hold circuit 4 is placed in the grounded state to cut the base current for transistor Q1. As a result, the transistor Q1 becomes "OFF state", which places the transistor Q2 also in "OFF state". Thus, the potential at point (B) becomes substantially the same as the source voltage Vcc (i.e. high), thereby causing the driver 8 to stop driving the light emitting diode 9 and buzzer 10. That is, the alarm is now canceled (by the reset operation).

The period of time for maintaining the output terminal of comparator 32 in "ON state" (to maintain the control switch 33 in "ON state") is adjusted by an additional circuit to be sufficient for completely cutting the supply of base current for the transistor Q1 in the lock hold circuit 4.

The main body 100 of the reset device may be installed in any location as long as it causes the resonance of the f2 resonator circuit 30 in the main body 1 of the self-sounding tag alarm apparatus.

<Second Embodiment>

Figure 3:
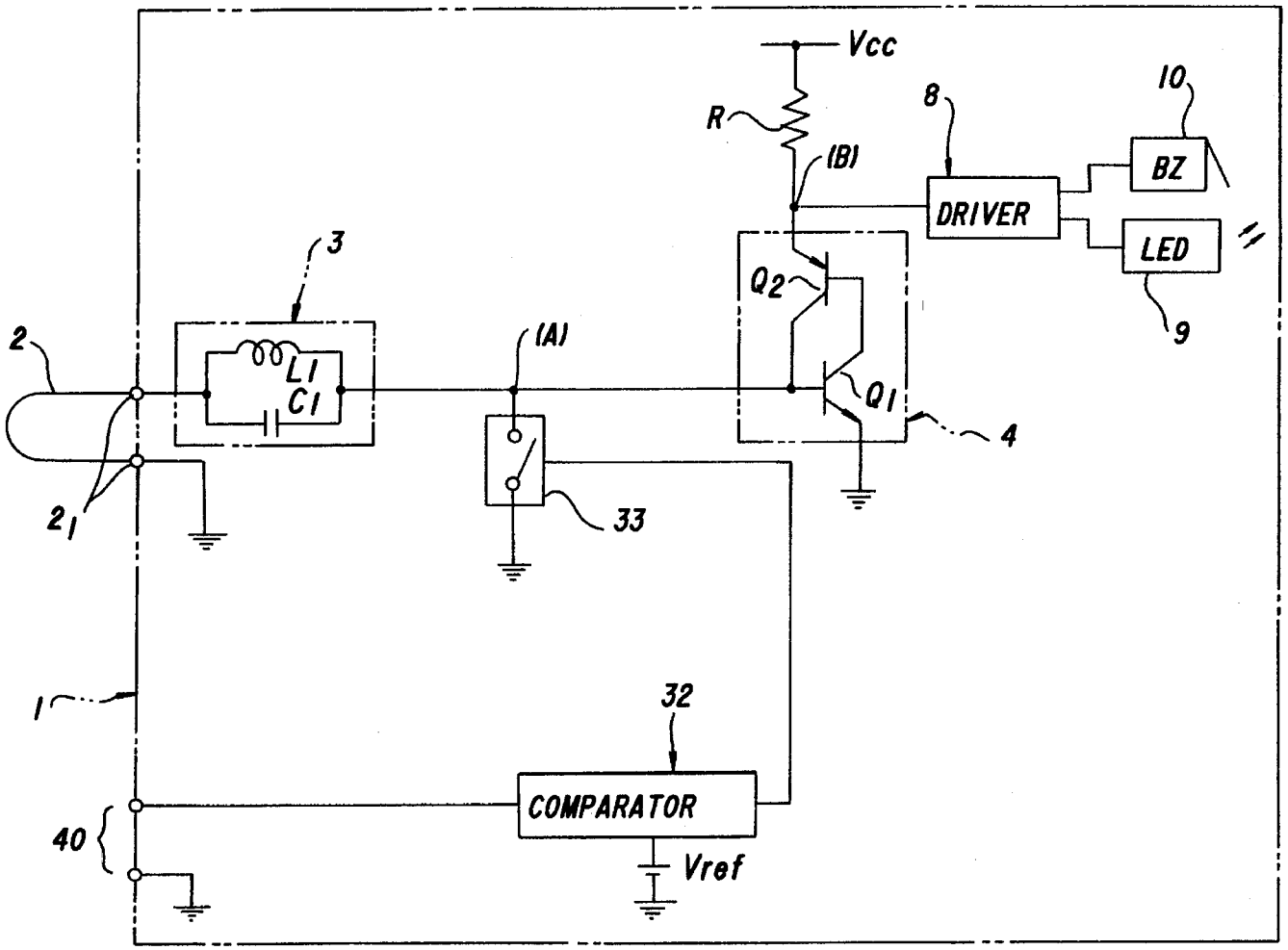
FIG. 3 is a circuit block diagram of a self-sounding tag alarm apparatus in a second embodiment of the invention.

FIG. 3 is a block diagram showing a self-sounding tag alarm apparatus attached in the wire mode according to the present invention.

In the drawing, the circuit block from the attaching wire 2 to the buzzer 10 is the same as in the first embodiment, and will not be described again.

Between the base terminal of transistor Q1 in the lock hold circuit 4 and the ground is connected a control switch 33 having a low-ON-state resistance. An output terminal of a comparator 32 is connected to a control terminal of the control switch 33. A reference voltage Vref is set to the comparator 32. One of external terminals 40 for connection externally of the main body 1 of the self-sounding tag alarm apparatus is connected to an input terminal of the comparator 32. The other external terminal 40 is grounded.

Operations of the main body 1 of this self-sounding tag alarm apparatus will be described next.

The operations in (1) Normal State, (2) Passage through a Gate, and (3) Wire Breaking are the same as in the first embodiment, and will not be described again.

(4) Reset Operation:

A reset operation for canceling the alarm given by the main body 1 of the self-sounding tag alarm apparatus will be described.

The reset operation is effected by applying a predetermined voltage exceeding the voltage Vref to the external terminals 40 of the main body 1 of the self-sounding tag alarm apparatus for an appropriate period of time. An outline of a reset device for applying the predetermined voltage will be described with reference to FIG. 2B.

Figure 2B:
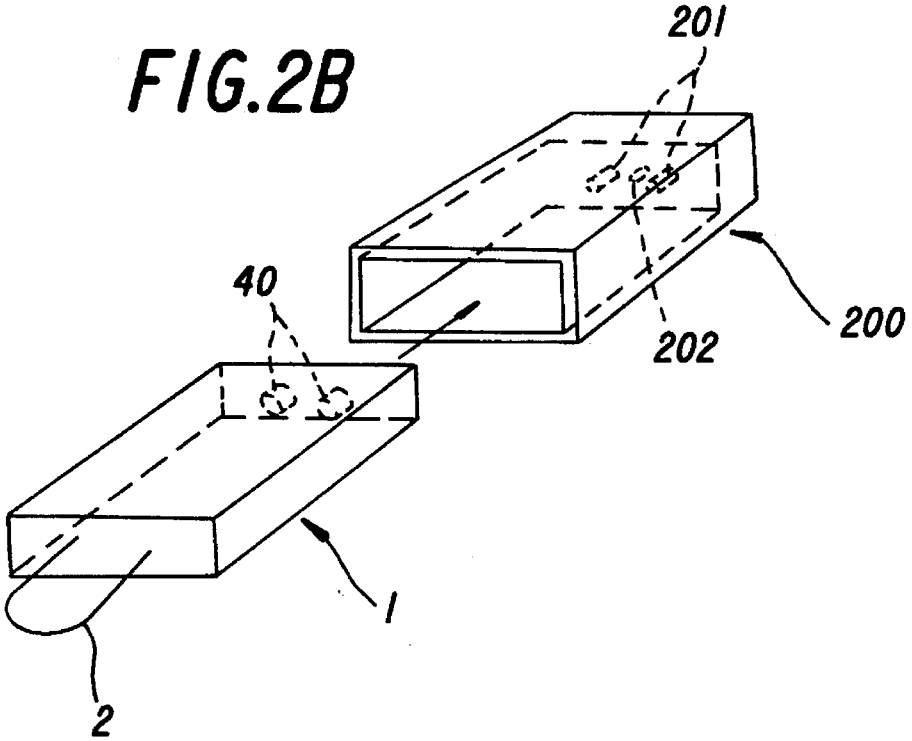

Numeral 200 in FIG. 2B denotes a main body of the reset device. The main body 200 contains a power source, not shown, for generating the voltage exceeding the voltage Vref. The main body 200 defines a hollow space having an opening substantially corresponding to an outer shape of the main body 1 of the self-sounding tag alarm apparatus.

Connection terminals 201 are arranged in a deep end of the hollow space, in positions corresponding to the external terminals 40 of the self-sounding tag alarm apparatus to apply the voltage to the external terminals 40. A detecting switch 202 is disposed between the connection terminals 201 to detect the main body 1 of the self-sounding tag alarm apparatus inserted into the hollow space, and to instruct output of a reset signal exceeding the voltage Vref from the power source.

The alarm is stopped by the following circuit action when the main body 1 of the self-sounding tag alarm apparatus giving the alarm is inserted through the opening in the main body 200 of the reset device.

The detecting switch 202 in the main body 200 of the reset device is pressed by the main body 1 of the self-sounding tag alarm apparatus, whereupon the power source in the main body 200 of the reset device applies the voltage Vref to the connection terminals 201. The voltage Vref applied to the connection terminals 201 is applied between the input terminal of comparator 32 and the ground through the external terminals 40 of the main body 1 of the self-sounding tag alarm apparatus. Subsequently, a circuit operation substantially the same as in the first embodiment is carried out.

That is, since the voltage inputted is higher than the reference voltage Vref, the comparator 32 places its output terminal in "ON state" to place the control switch 33 in "ON state". Consequently, the potential at point (B) becomes substantially the same as the source voltage Vcc (i.e. high), thereby causing the output terminal of driver 8 to stop driving the light emitting diode 9 and buzzer 10.

The period of time for maintaining the output terminal of comparator 32 in "ON state" is adjusted by an additional circuit as in the first embodiment.

<Third Embodiment>

Figure 4:
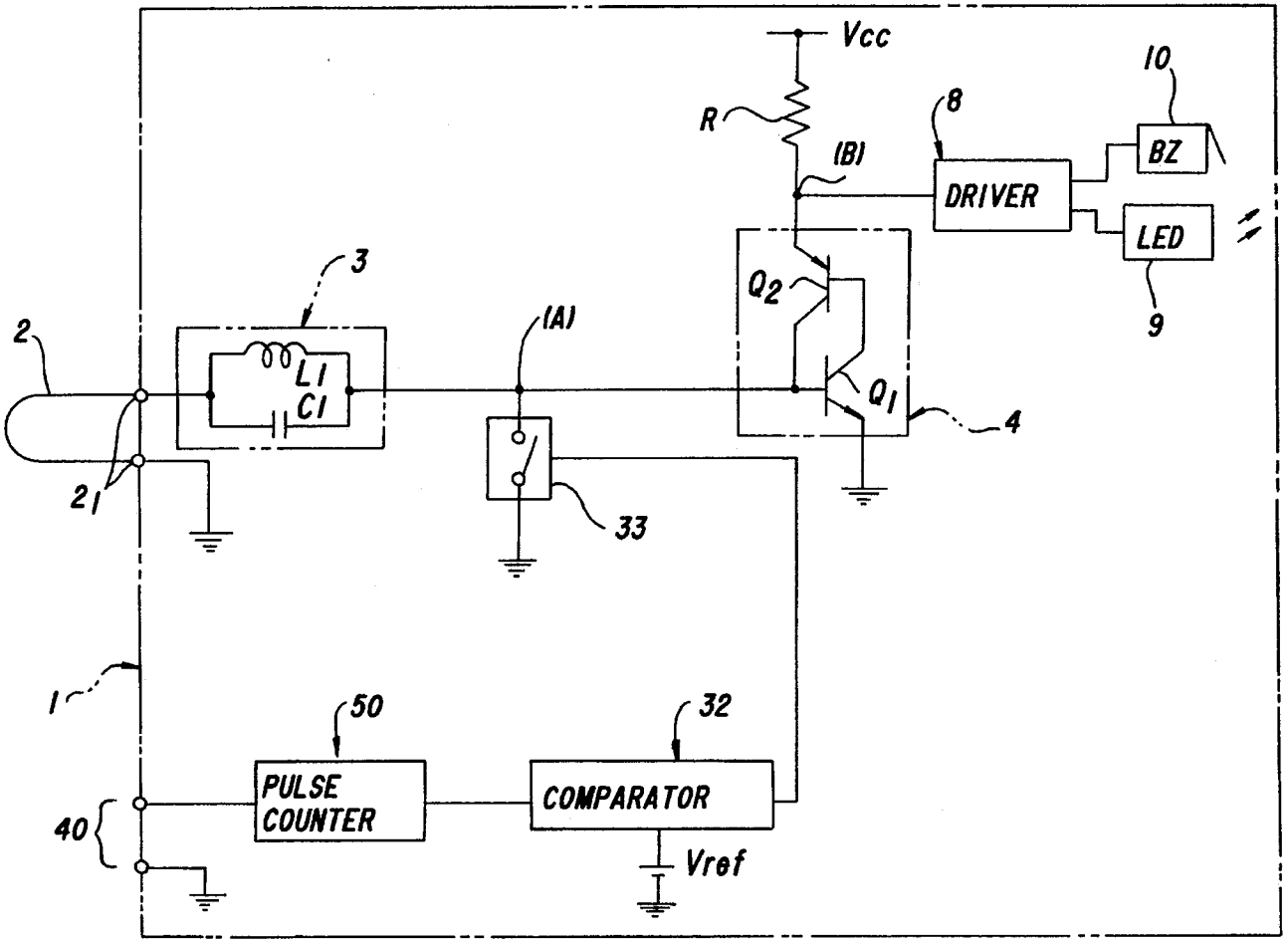
FIG. 4 is a circuit block diagram of a self-sounding tag alarm apparatus in a third embodiment of the invention.

FIG. 4 is a block diagram showing a self-sounding tag alarm apparatus attached in the wire mode according to the present invention.

In the drawing, the circuit block from the attaching wire 2 to the buzzer 10 is the same as in the first embodiment, and will not be described again.

Between the base terminal of transistor Q1 in the lock hold circuit 4 and the ground is connected a control switch 33 having a low ON-state resistance. An output terminal of a comparator 32 is connected to a control terminal of the control switch 33. A reference voltage Vref is set to the comparator 32. An output terminal of a pulse counter 50 is connected to an input terminal of the comparator 32. One of external terminals 40 for connection externally of the main body 1 of the self-sounding tag alarm apparatus is connected to an input terminal of the pulse counter 50. The other external terminal 40 is grounded.

The pulse counter 50 is formed of a logic circuit for outputting a predetermined voltage to its output terminal upon counting a predetermined number of pulses (e.g. three pulses) at the input terminal. With other numbers of pulses inputted, the voltage at the output terminal substantially corresponds to the ground. The output voltage from the output terminal is adjusted by a component added to this circuit, to be the same as or higher than the voltage Vref.

The pulse counter 50 for counting pulses may be replaced by a pulse width detecting circuit formed of a logic circuit for outputting a predetermined output voltage to an output terminal upon detection of a particular signal having a predetermined pulse width, or a pulse code detecting circuit formed of a logic circuit for carrying out a similar operation upon detection of a predetermined pulse code (i.e. a particular signal).

Operations of the main body 1 of this self-sounding tag alarm apparatus will be described next.

The operations in (1) Normal State, (2) Passage through a Gate, and (3) Wire Breaking are the same as in the first embodiment, and will not be described again.

(4) Reset Operation:

A reset operation for canceling the alarm given by the main body 1 of the self-sounding tag alarm apparatus will be described.

The reset operation is effected by applying three pulses of a predetermined voltage through the external terminals 40 to the main body 1 of the self-sounding tag alarm apparatus. An outline of a reset device for applying the predetermined voltage will be described with reference to FIG. 2B.

Numeral 200 in FIG. 2B denotes a main body of the reset device. The main body 200 contains a power source, not shown, for generating three pulses of the predetermined voltage. The main body 200 defines a hollow space having an opening substantially corresponding to an outer shape of the main body 1 of the self-sounding tag alarm apparatus. Connection terminals 201 are arranged in a deep end of the hollow space, in positions corresponding to the external terminals 40 of the self-sounding tag alarm apparatus to apply the pulse voltage to the external terminals 40. A detecting switch 202 is disposed between the connection terminals 201 to detect the main body 1 of the self-sounding tag alarm apparatus inserted into the hollow space, and to instruct output of a reset signal (three voltage pulses) from the power source.

The alarm is stopped by the following circuit action when the main body 1 of the self-sounding tag alarm apparatus giving the alarm is inserted through the opening in the main body 200 of the reset device.

The detecting switch 202 in the main body 200 of the reset device is pressed by the main body 1 of the self-sounding tag alarm apparatus, whereupon the power source in the main body 200 of the reset device applies the three voltage pulses to the connection terminals 201. The pulses applied to the connection terminals 201 are applied between the input terminal of pulse counter 50 and the ground through the external terminals 40 of the main body 1 of the self-sounding tag alarm apparatus.

The pulse counter 50, upon counting the three pulses at the input terminal, outputs the voltage equal to or higher than the voltage Vref to the output terminal. Its logic construction is such that, with other numbers of pulses inputted, the voltage at the output terminal is substantially the same as the ground. Here, the voltage equal to or higher than the voltage Vref is outputted to the output terminal. Subsequently, a circuit operation substantially the same as in the first embodiment is carried out.

That is, upon receipt from the pulse counter 50 of the voltage equal to or higher than the reference voltage Vref, the comparator 32 places the output terminal in "ON state" to place the control switch 33 in "ON state". Consequently, the potential at point (B) becomes substantially the same as the source voltage Vcc (i.e. high), thereby causing the output terminal of driver 8 to stop driving the light emitting diode 9 and buzzer 10.

The period of time for maintaining the output terminal of comparator 32 in "ON state" is adjusted as in the first embodiment.

<Fourth Embodiment>

Figure 5:
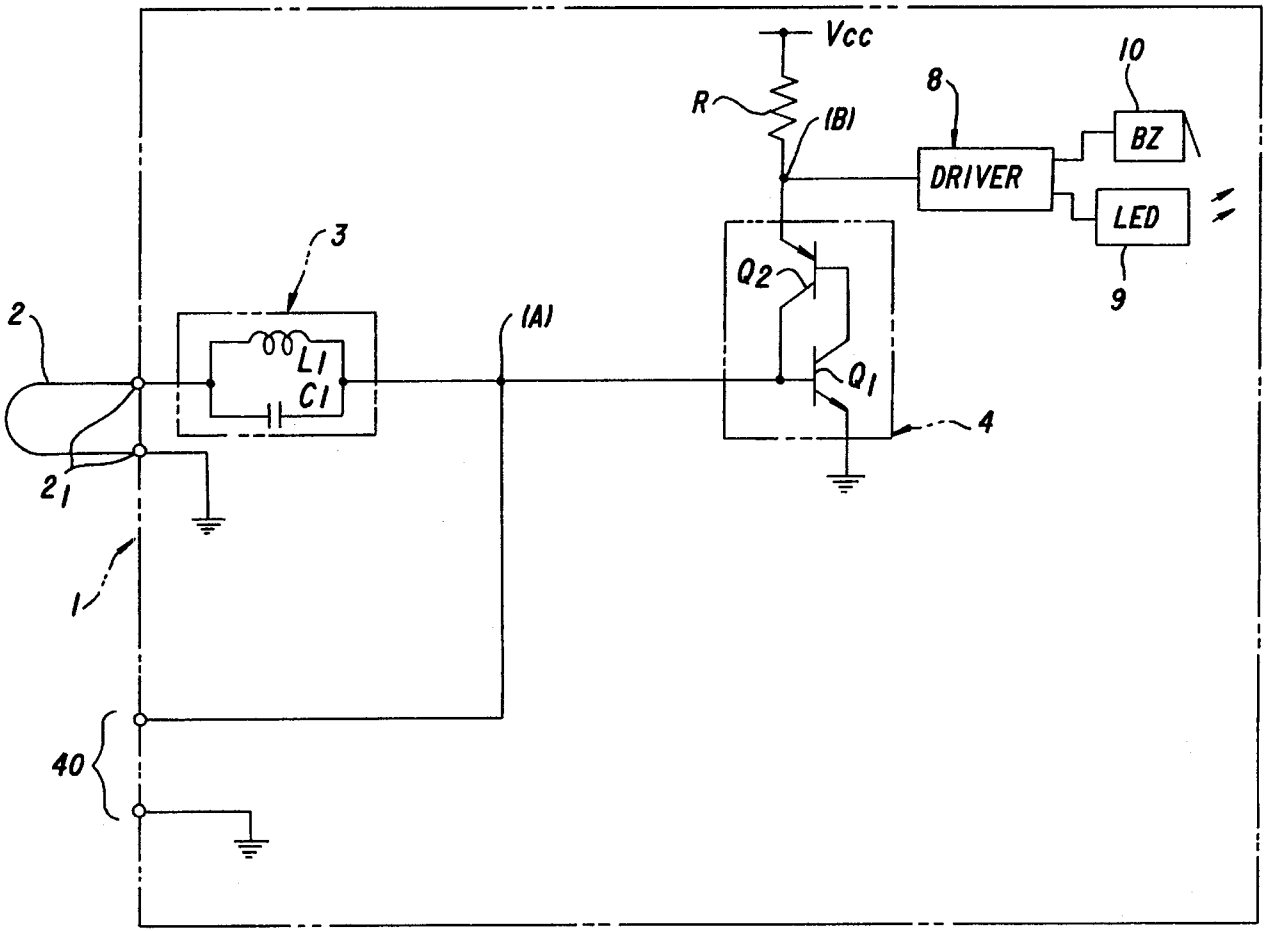
FIG. 5 is a circuit block diagram of a self-sounding tag alarm apparatus in a fourth embodiment of the invention.

FIG. 5 is a block diagram showing a self-sounding tag alarm apparatus attached in the wire mode according to the present invention.

In the drawing, the circuit block from the attaching wire 2 to the buzzer 10 is the same as in the first embodiment, and will not be described again.

The base terminal of transistor Q1 in the lock hold circuit 4 is connected to one of external terminals 40 for connection externally of the main body 1 of the self-sounding tag alarm apparatus. The other external terminal 40 is grounded.

Operations of the main body 1 of this self-sounding tag alarm apparatus will be described next.

The operations in (1) Normal State, (2) Passage through a Gate, and (3) Wire Breaking are the same as in the first embodiment, and will not be described again.

(4) Reset Operation:

A reset operation for canceling the alarm given by the main body 1 of the self-sounding tag alarm apparatus will be described.

The reset operation is effected by short-circuiting between the external terminals 40 of the main body 1 of the self-sounding tag alarm apparatus. An outline of a reset device for establishing the short circuit will be described with reference to FIG. 6A.

Figure 6A:
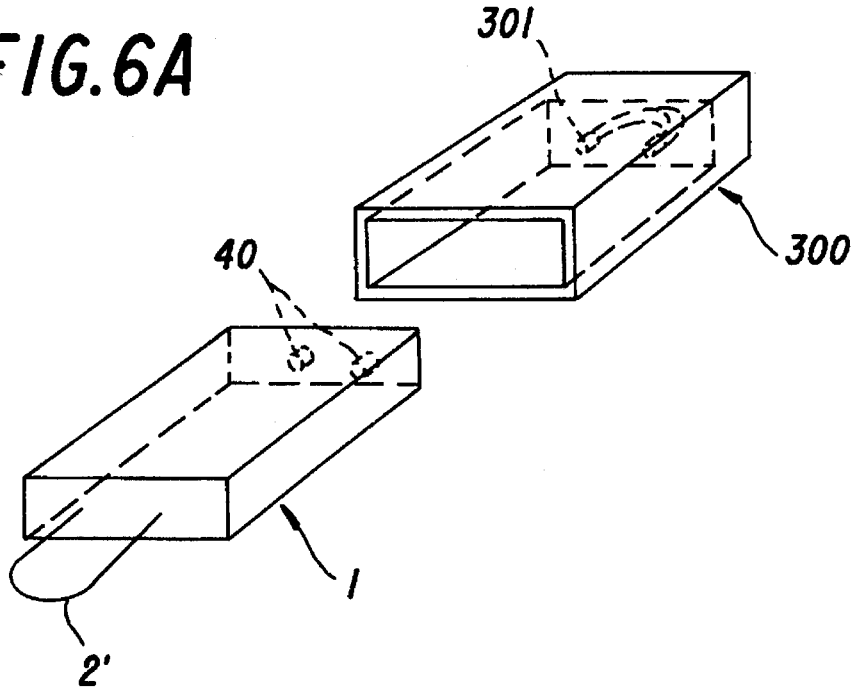
FIGS. 6A and 6B are views each showing an outline of a reset device.

Numeral 300 in FIG. 6A denotes a main body of the reset device. The main body 300 defines a hollow space having an opening substantially corresponding to an outer shape of the main body 1 of the self-sounding tag alarm apparatus. Short-circuit terminals 301 are arranged in a deep end of the hollow space, in positions corresponding to the external terminals 40 of the self-sounding tag alarm apparatus to short-circuit the external terminals 40.

The alarm is stopped by the following circuit action when the main body 1 of the self-sounding tag alarm apparatus giving the alarm is inserted through the opening in the main body 300 of the reset device.

The short-circuit terminals 301 in the main body 300 of the reset device short-circuit the external terminals 40 of the main body 1 of the self-sounding tag alarm apparatus to ground potential. Then, the potential at point (A) substantially corresponds to the ground, to place the collector terminal of transistor Q2 in the lock hold circuit 4 in the grounded state to cut the base current for transistor Q1. As a result, the transistor Q1 becomes "OFF state", which places the transistor Q2 also in "OFF state". Thus, the potential at point (B) becomes substantially the same as the source voltage Vcc (i.e. high), thereby causing the output terminal of driver 8 to stop driving the light emitting diode 9 and buzzer 10.

<Fifth Embodiment>

Figure 7:
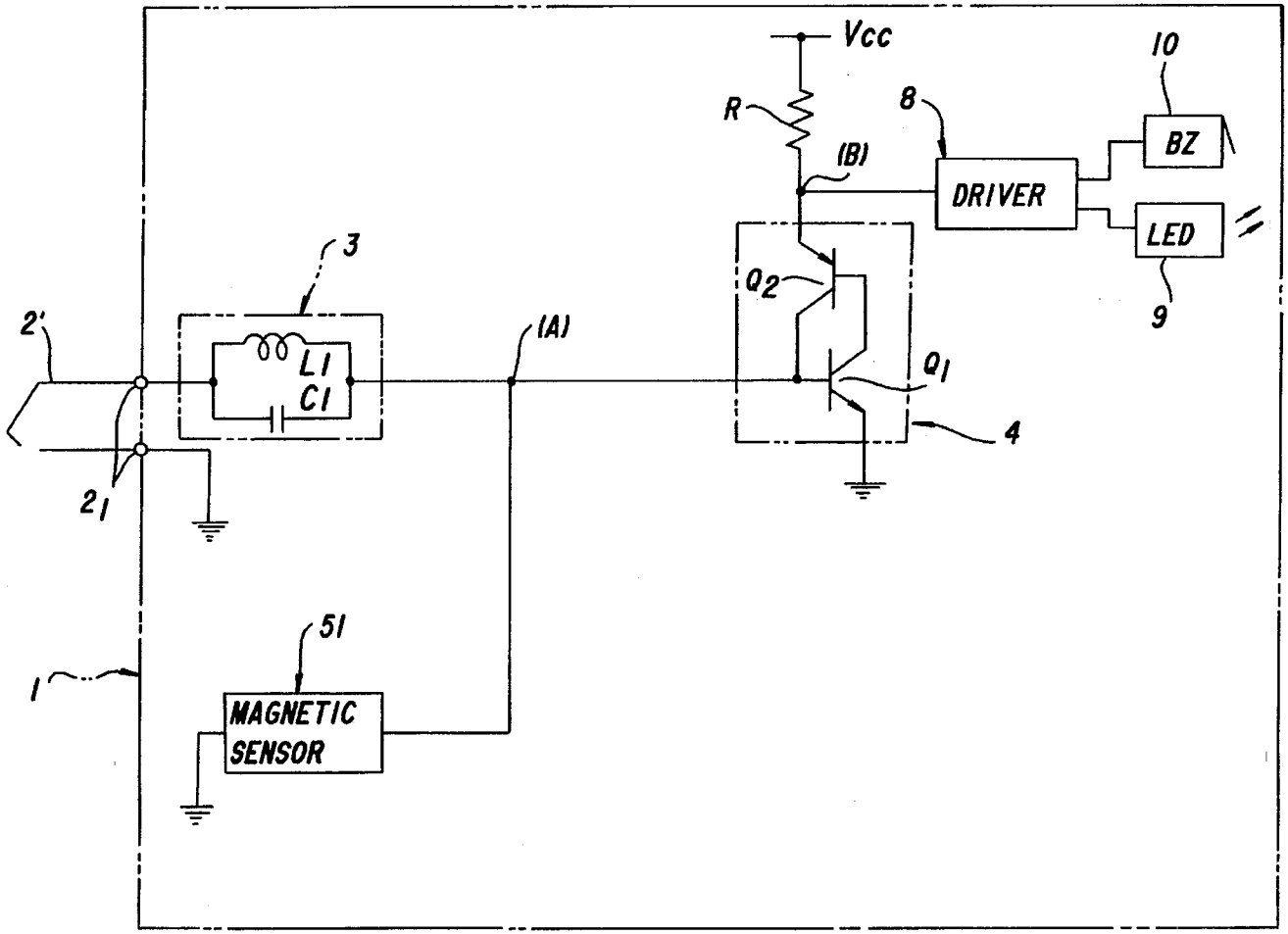
FIG. 7 is a circuit block diagram of a self-sounding tag alarm apparatus in a fifth embodiment of the invention.

FIG. 7 is a block diagram showing a self-sounding tag alarm apparatus attached in the wire mode according to the present invention. In FIG. 7, however, the wire is schematically illustrated as a coupling device 2', and could be a wire, a pin, a clip, or adhesive tape.

In the drawing, the circuit block from the device 2' to the buzzer 10 is the same as in the first embodiment, and will not be described again.

The base terminal of transistor Q1 in the lock hold circuit 4 is grounded through a magnetic sensor 51, for example, of the normally open lead switch type.

Operations of the main body 1 of this self-sounding tag alarm apparatus will be described next.

The operations in (1) Normal State, (2) Passage through a Gate, and (3) Wire Breaking are coupling device detachment are the same as in the first embodiment, and will not be described again.

(4) Reset Operation:

A reset operation for canceling the alarm given by the main body 1 of the self-sounding tag alarm apparatus will be described.

The reset operation is effected by placing a magnet or the like for forming a magnetic field close to the magnetic sensor 51 in the main body 1 of the self-sounding tag alarm apparatus. An outline of a reset device for carrying out this operation will be described with reference to FIG. 6B.

Figure 6B:
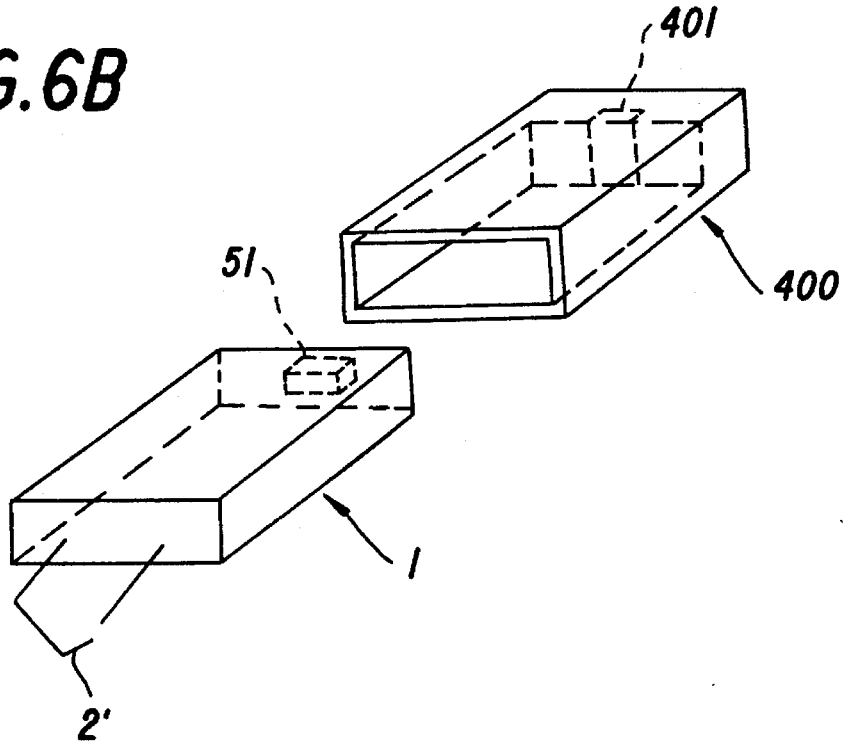

Numeral 400 in FIG. 6B denotes a main body of the reset device. The main body 400 defines a hollow space having an opening substantially corresponding to an outer shape of the main body 1 of the self-sounding tag alarm apparatus. A magnet 401 is disposed in a deep end of the hollow space, in a position corresponding to the magnetic sensor 51 in the self-sounding tag alarm apparatus. The magnet 401 has an appropriate magnetic force to operate the magnetic sensor 51.

The alarm is stopped by the following circuit action when the main body 1 of the self-sounding tag alarm apparatus giving the alarm is inserted through the opening in the main body 400 of the reset device.

The magnet 401 in the main body 400 of the reset device closes the magnetic sensor 51 in the main body 1 of the self-sounding tag alarm apparatus. As a result, the collector terminal of transistor Q2 in the lock hold circuit 4 is short-circuited to ground potential. Then, substantially the same circuit operation as in the fourth embodiment takes place.

That is, the potential at point (B) becomes substantially the same as the source voltage Vcc (i.e. high), thereby causing the output terminal of driver 8 to stop driving the light emitting diode 9 and buzzer 10.

(5) Reset Sequence for Normal Accounting:

A sequence of resetting the self-sounding tag alarm apparatus in a proper shopping action in which the commodity with the main body 1 of the alarm apparatus is brought to a cashier's counter will be described.

Having received the commodity, the cashier places the main body 1 of the self-sounding tag alarm apparatus in the first embodiment, along with the commodity, above the main body 100 of the reset device, and removes the coupling device 2'. In this state, the electromagnetic wave of frequency f2 emitted from the main body 100 of the reset device maintains the lock hold circuit 4 in "OFF state". Thus, an alarm is not given even if the coupling device 2' is removed.

The coupling device 2' is restored on the main body 1 of the self-sounding tag alarm apparatus now separated, and the apparatus is stored in an appropriate location. The main body 1 of the self-sounding tag alarm apparatus is used repeatedly. The main body 1 is placed above the main body 100 of the reset device when attaching it to a next commodity.

In the second and third embodiments, the main body 1 of the self-sounding tag alarm apparatus as attached to the commodity is inserted through the opening into the hollow space of the main body 200 of the reset device. Then, the coupling device 2' is detached. In this state, because of the predetermined voltage or pulses outputted from the main body 200 of the reset device, an alarm is not given even if the coupling device 2' is removed.

The main body 1 of the self-sounding tag alarm apparatus is used repeatedly as in the preceding embodiment. The main body 1 is inserted into the main body 200 of the reset device when attaching it to a next commodity.

In the fourth embodiment (and the fifth embodiment), the main body 1 of the self-sounding tag alarm apparatus as attached to the commodity is inserted through the opening into the hollow space of the main body 300 (or 400) of the reset device. Then, the device 2' is detached. In this state, the main body 300 of the reset device short-circuits the external terminals 40 of the main body 1 of the self-sounding tag alarm apparatus, while the main body 400 of the reset device actuates the magnetic sensor 51. Thus, an alarm is not given even if the coupling device 2' is removed.

The main body 1 of the self-sounding tag alarm apparatus is used repeatedly as in the preceding embodiments. The main body 1 is inserted into the main body 300 (or 400) of the reset device when attaching it to a next commodity.

The above embodiments have been described, exemplifying the main body of the self-sounding tag alarm apparatus having an outer shape of a rectangular parallelopiped. The present invention is not limited to such a shape, but may employ various tag shapes. Further, the invention is not limited to the self-sounding tag alarm apparatus of the electromagnetic induction coupling type, but is applicable also to a self-sounding tag alarm apparatus of the microwave type.

Further, the present invention may be worked in the following modified form.

The first embodiment described hereinbefore, for example, includes the resonator circuit 3 for detecting the electromagnetic wave of frequency f1 to operate the main body 1 of the self-sounding tag alarm apparatus, and the separate resonator circuit 30 for detecting the electromagnetic wave of frequency f2 to reset the main body 1 of the apparatus. The two resonator circuits may be integrated into a single resonator circuit. That is, two types of burst signals comprising the same carrier frequency are used as a signal for operating the main body 1 and a signal for resetting the main body 1, respectively. Then, the main body 1 may have only a single resonator circuit corresponding to the carrier frequency. In this case, whether a demodulated pulse signal is an alarm operating signal or a reset signal is determined within the main body 1 to effect an appropriate operation (alarm operation or reset operation).

The present invention may be embodied in other specific forms without departing from the spirit or essential attributes thereof and, accordingly, reference should be made to the appended claims, rather than to the foregoing specification, as indicating the scope of the invention.

What is claimed is:

1. A self-sounding tag alarm apparatus for use on a commodity to prevent shoplifting, said apparatus comprising:

a main housing;

coupling means for detachably attaching the main housing to the commodity;

alarm generating means mounted in said main housing for generating an alarm;

detecting means for detecting at least one of a signal of a particular frequency produced externally of said main housing and removal of said coupling means;

reset signal input means on said main housing for having a reset signal applied thereto, said reset signal being provided externally of said main housing, said reset signal input means including a resonator circuit for detecting an electromagnetic wave of a predetermined frequency, said electromagnetic wave of a predetermined frequency being different from the signal of a particular frequency produced externally of said main housing, and a comparator, said comparator being enabled when an output of said resonator circuit exceeds a predetermined level; and reset signal generating means for generating the electromagnetic wave of a predetermined frequency, said electromagnetic wave of a predetermined frequency being a reset signal, said reset signal generating means including an oscillator coil disposed in a flat housing.

2. An apparatus as defined in claim 1, wherein said coupling means comprises a wire for connecting said main housing to said commodity, and wherein said detecting means generates electrical signals in response to connection and disconnection of said wire to and from said main housing.

3. An apparatus as defined in claim 1, wherein said coupling means comprises a pin for connecting said main housing to said commodity, and wherein said detecting means generates electrical signals in response to connection and disconnection of said pin to and from said main housing.

4. An apparatus as defined in claim 1, wherein said coupling means comprises a clip for connecting said main housing to said commodity, and wherein said detecting means generates electrical signals in response to connection and disconnection of said clip to and from said main housing.

5. An apparatus as defined in claim 1, wherein said coupling means comprises an adhesive tape for connecting said main housing to said commodity, and wherein said detecting means generates electrical signals in response to connection and disconnection of said adhesive tape to and from said main housing.

6. An apparatus as defined in claim 1, wherein said detecting means includes a resonator circuit for detecting an electromagnetic wave which is said signal of a particular frequency produced externally of said main housing.

* * * * *